United States Patent [19]

Peterson, Jr. et al.

[11] 4,241,710

[45] Dec. 30, 1980

[54] CLOSED LOOP SYSTEM

[75] Inventors: William A. Peterson, Jr., Rochester; Roman O. Marchak, Northville, both of Mich.

[73] Assignee: The Bendix Corporation, Southfield, Mich.

[21] Appl. No.: 918,180

[22] Filed: Jun. 22, 1978

[51] Int. Cl.[3] ..... F02M 7/00

[52] U.S. Cl. ..... 123/440; 123/489

[58] Field of Search ..... 123/119 EC, 32 EE, 117 D; 60/276, 28 J

[56] References Cited

U.S. PATENT DOCUMENTS

| | | | |
|---|---|---|---|
| 3,782,347 | 1/1974 | Schmidt et al. | 123/32 EE |
| 3,831,564 | 8/1974 | Schmidt et al. | 123/32 EE |
| 3,875,907 | 4/1975 | Wessel et al. | 60/276 |
| 4,040,394 | 8/1977 | Wahl et al. | 123/119 EC |
| 4,046,118 | 9/1977 | Aono | 123/119 EC |
| 4,088,095 | 5/1978 | Aono | 60/28 J |
| 4,089,313 | 5/1978 | Asano et al. | 123/119 EC |
| 4,121,548 | 10/1978 | Hattori et al. | 123/119 EC |
| 4,167,924 | 9/1979 | Carlsen et al. | 123/119 EC |

*Primary Examiner*—Charles J. Myhre
*Assistant Examiner*—Raymond A. Nelli
*Attorney, Agent, or Firm*—William A. Marvin; Russel C. Wells

[57] ABSTRACT

A closed loop system for the control of the air/fuel ratio of an internal combustion engine is disclosed. The system includes an open loop air/fuel ratio controller that has a closed loop correction applied to its basic pulse width control signal. The closed loop correction is based upon the bi-level switching of an oxygen sensor detecting a substantially stoichiometric condition in the exhaust gas of the internal combustion engine. Performing the correction is an integral controller which responds to the switching of the exhaust gas sensor to increase the air/fuel ratio for one level of the sensor and to decrease the air/fuel ratio for the other level. The limit cycle oscillation developed by the integral controller is modified by increasing the authority and gain rate of the controller as a function of the distance the system is away from a reference point so that it responds to transient conditions rapidly and smoothly. Another aspect of the invention provides for the authority modification to take place when the controller reaches a threshold and to employ minimum constant authority for quiescent conditions. Also, in response to a closed throttle or idle condition the quiescent authority level is reduced to a convenient idle level to prevent torque roll.

16 Claims, 8 Drawing Figures

CLOSED LOOP SYSTEM

BACKGROUND OF THE INVENTION

1. Field of the Invention

The invention pertains generally to air/fuel ratio controllers for internal combustion engines and is more particularly directed to closed loop systems utilizing integral control.

2. Prior Art

Open loop air/fuel ratio schedulers were developed as a means of providing the precision injection timing and regulation needed to control electromagnetic fuel injectors in electronic fuel injection systems. This precise regulation of electronic fuel injection systems is necessary for the reduction of noxious emissions and for the economization of fuel.

The open loop scheduler receives a plurality of engine operating parameters for various sensors such as manifold absolute pressure MAP, RPM, air temperature, coolant temperature, etc. These engine parameters describe the amount of fuel that is required to be injected for the particular operating condition of the engine according to a schedule. The schedule is generally based upon the amount of fuel that is necessary to provide a stoichiometric air/fuel ratio for the mass air flow inducted into the engine. The open loop schedule is a fixed calculation or function developed by careful measurement and data taken from a representative vehicle. It is clear that one schedule will not be able to provide exact stoichiometric operation for all vehicles because of differing tolerances in assembly and different equipment configurations. Moreover, wear and aging will affect certain systems more than others.

Adaptive or closed loop correction is now used to overcome these difficulties in open loop systems. One type of closed loop system used to advantage has been the closed loop $O_2$ system. This system comprises basically an oxygen sensor detecting the oxygen content of the exhaust gas of the internal combustion engine and an integral controller. The integral controller will respond to the oxygen sensor detecting the presence of oxygen (a lean condition) by increasing the fuel flow factorially and will respond to the detecting the absence of oxygen (a rich condition by decreasing the fuel flow factorially.

A characteristic limit cycle oscillation is thus developed with a stoichiometric air/fuel ratio being the average or base reference. The peak correction provided by the integrator for the limit cycle is determined mainly by the gain or ramp rate of the integral controller and the transport delay which a charge of fuel and air experiences from its induction into the cylinders to its detection at the $O_2$ sensor as exhaust gas. Generally the limit cycle oscillation has a period of approximately $4\tau$ where $\tau$ is the transport delay time. The peak-to-peak correction of the integral controller is on the order of twice the ramp rate multiplied by the transport lag. The transport lag is inversely proportional to the speed or RPM of the engine in a substantially linear manner.

Although the closed loop $O_2$ controller provides an advantageous method of correcting the open loop fuel schedule for variations in vehicles, precision limitations of open loop calibration, aging, and wear conditions, there are still some problems with the system dynamics of such a controller.

The amount of system gain and consequently the amount of correction of such a system is a tradeoff between transient response and quiescent response. At steady state conditions, constant load or RPM, the gain of such a system should be small as a large integrator ramp rate will introduce torque roll and an unevenness in the engine performance. With these steady state conditions present, ramp rate (gain) and authority should be enough to just correct for the aging factors to keep the system in calibration.

This low gain while providing excellent quiescent correction is much to slow for transient responses where a relatively large change in air/fuel ratio may be needed immediately or operating conditions have changed the fuel requirements far from the original operating point.

Thus, many present closed loop $O_2$ systems use a gain rate that is slower than that desired for transients but faster than that desired for steady state. This is not a solution to the problem but merely a compromise between what is desirable and what is considered an operational system.

There is one system disclosed in U.S. Pat. No. 3,782,347 issued to Schmidt et al that attempts to solve this problem by switching the integration rate of the controller from one fixed rate to a faster fixed rate in response to the $O_2$ sensor remaining in one state for a set period of time. This system will overshoot small transients just outside the timing range because of the high gain rate it switches to once the time period has elapsed. It may take a number of cycles to return to steady state in a worst case condition because of the uni-directional gain rate correction.

Another system disclosed in U.S. Pat. No. 3,831,564 changes an integral controller gain rate in response to an operating parameter of the engine. The method, however, does not allow the closed loop $O_2$ system to return to a steady state condition once a suspected transient has been corrected for and may cause gain rates and authority levels incompatible with smooth system operation. Further, this system will not deliver a high gain rate at a low level of the controlling varible which may be necessary. Such a system would not be advantageous during decelerations where the manifold absolute pressure would be dropping significantly.

SUMMARY OF THE INVENTION

The invention provides a closed loop system for the control of the air/fuel ratio of an internal combustion engine. The closed loop system includes a means for modifying the authority of an integral controller according to the error in the system. If the system error is large and the controller senses that large corrections are needed, the authority of the integral controller will be increased according to a functional control law until it is a maximum value. For errors that are smaller or within a steady state band, the authority of the integrator will be reduced until it is a minimum value.

In one preferred implementation of the invention the system error is detected as the magnitude of the integral control voltage away from a reference level. The larger the absolute magnitude of the integral control voltage becomes the greater the authority level will become and the higher the gain rate. Therefore, transients or error on negative or positive swings of the reference level for the integral controller will be corrected for quickly without extensive overshooting.

In another preferred implementation the absolute magnitude of the rate of change of an engine operating parameter related to air/fuel ratio is detected as the system error. The magnitude of the rate of change of an operating parameter related to air/fuel ratio is a prediction of the amount of change the air/fuel ratio controller will have to accomplish. Further, it is an indication of the rate at which the change should be accomplished. Detecting system error in this manner will provide a simple and effective means for adapting the closed loop $O_2$ system to transients. This second implementation can be used in combination with the first implementation or independently. If used in combination, the controller will be able to correct adequately for non-operator induced transients under the control of the first implementation and will further respond rapidly to the transients which include accelerations and decelerations by means of the second implementation.

Another implementation senses an idle condition as a special steady state condition and modifies the integrator authority to provide closed loop control without excessive torque changes in the system.

Therefore, it is the primary object of the invention to provide a closed loop integral controller which has a system gain proportional to the error in air/fuel ratio.

It is another object of the invention to provide the closed loop system with a faster response to transients without overshooting the desired point of transition.

It is still another object of the invention to provide a steady state gain compatible with quiescent conditions of relatively constant speed and load.

It is yet another object of the invention to provide a steady state idle authority that will provide closed loop control.

Another object of the invention is to measure the error in the air/fuel ratio by the difference between the absolute magnitude of the integral controller voltage and a reference or no error condition.

Another object of the invention is to measure the error in the air/fuel ratio by the absolute magnitude of the rate of change of an engine parameter related to air/fuel ratio.

These and other objects, features, and aspects of the invention will be more fully understood and better appreciated from a reading of the following detailed disclosure taken in conjunction with the appended drawings wherein:

DETAILED DESCRIPTION

Figure 1:
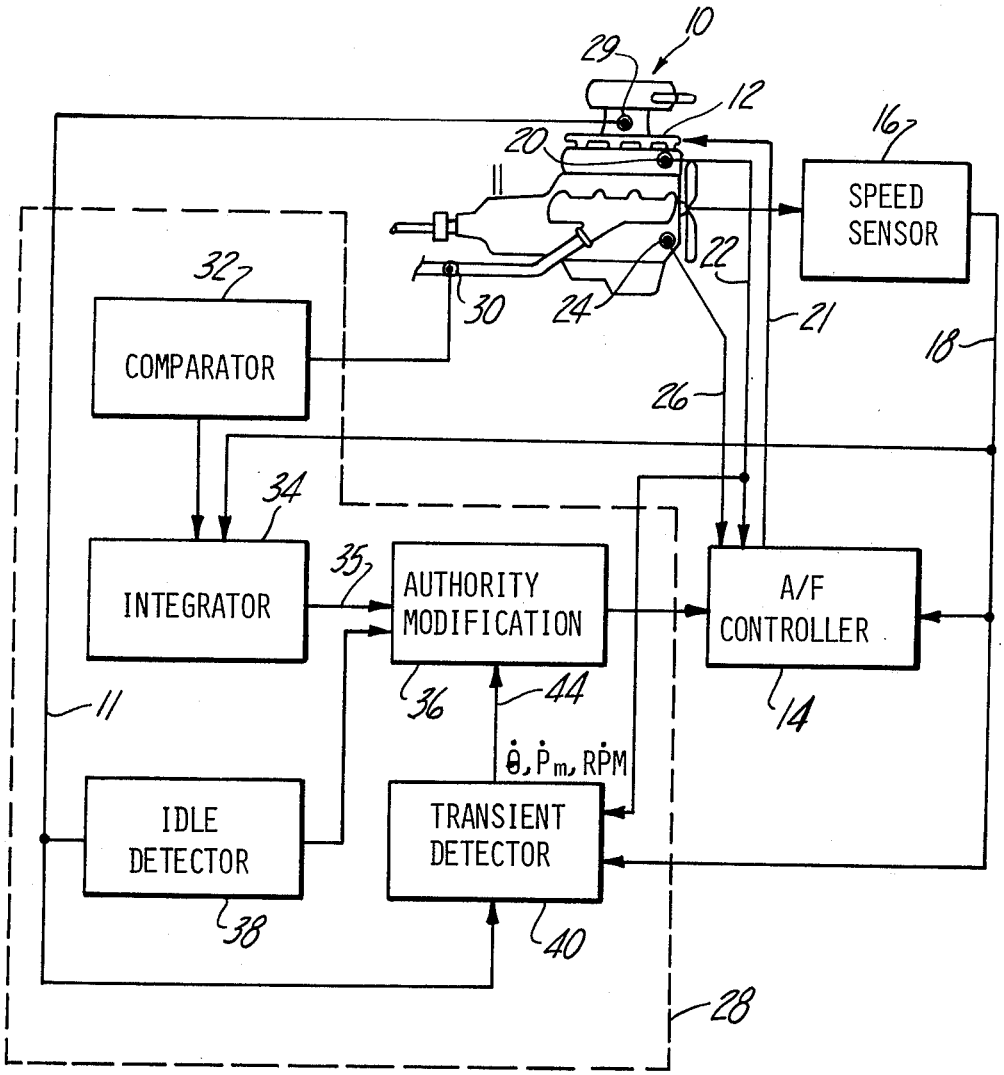
FIG. 1 is a system block diagram of an internal combustion engine with a closed loop air/fuel controller constructed in accordance with the invention.

With reference now to the first detailed drawing FIG. 1, there is shown an internal combustion engine 10 including an air/fuel ratio controller 14. The air/fuel ratio controller 14 is an electronic computer which applies an open loop fuel schedule to the operating parameters of the internal combustion engine and calculates a pulse width signal therefrom. For example, the schedule may be stored in a read only memory having a matrix of pulse width values accessed by addressing the values according to the value of any number of operating parameters such as the manifold absolute pressure and the speed of the engine.

The output signal of the air/fuel ratio controller 14 is used to drive a plurality of solenoid actuated fuel injection valves in a fuel injector assembly 12 by means of the electronic pulse width signals carried via conductors 21. The opening times of the injectors and thus the amount of fuel delivered is controlled by the duration of the drive pulses from the controller.

Any number of operating parameters of the engine may be sensed to calculate the required fuel. Generally, speed or RPM from a speed sensor 16 transmitted via conductor 18 and manifold absolute pressure (MAP) from a pressure sensor 20 inserted into the manifold of the engine 10 transmitted via conductor 22 are used. These parameters are combined to yield an approximation of the mass air flow induced into the engine. Other parameters such as temperature from a temperature sensor (air and engine coolant) 24 transmitted via conductor 26 may also be advantageously provided.

The basic calibration of the air/fuel ratio controller 14 provides an amount of fuel that will produce a stoichiometric ratio and thus fairly good economy and few emissions from the engine 10 when used with a catalytic converter. The base calibration is used as the combination of RPM and manifold absolute pressure corrected with temperature which will give a substantially close calculation of the mass air flow from which to calculate the amount of fuel needed for the desired A/F ratio which occurs around stoichiometry.

Other parameters may be combined to provide specialized conditions such as starting where a rich air/fuel ratio will be needed to run the engine smoothly, for cold operation when the engine is not up to standard operating temperature, or for altitude compensation. All these measured operating parameters may be combined in the air/fuel ratio controller 14 to get a fairly accurate calculation of the amount of fuel needed to maintain the desired air/fuel ratio under open loop control.

An analog computer of this type is more fully described in a U.S. Pat. No. 3,734,068 issued to Reddy on May 22, 1973 entitled "Fuel Injection Control System" which is commonly assigned with the present application. The disclosure of Reddy is herein expressly incorporated by reference.

However, when the system begins to age or mechanical wear causes the volumetric efficiency of the engine to change, the open loop calibration will not provide an accurate enough calculation for emission control standards. Therefore, to provide a closed loop correction a closed loop system 28 has been provided.

An example of a closed loop fuel management control system utilizing an $O_2$ sensor is disclosed in a U.S. Pat. No. 3,815,561 issued to Seitz on June 11, 1974 which is commonly assigned with the present application. The disclosure of Seitz is herein expressly incorporated by reference.

The present closed loop correction system 28 comprises an oxygen sensor 30 located within the exhaust system of the engine 10 to sense the oxygen content. The oxygen sensor 30 is generally a measuring device which gives a signal of whether the exhaust gas of the engine 10 contains oxygen or does not contain oxygen by sensing the differences in partial pressures between oxygen gas in the exhaust system and a reference port generally vented to the atmosphere. The sensor may comprise a zirconia tube with plated platinum electrodes as known in the art.

A first level of a relatively high voltage is developed when the sensor 30 determines their is little oxygen or a relative absence of such in the exhaust gas. This indicates incomplete combustion or the existence of a rich condition. A second level occurs when the oxygen sensor 30 senses the presence of oxygen in the exhaust gas of the engine 10. This condition occurs when the engine mixture is overcombusted or too lean. When the exhaust gas changes from a relative abundance to a relative absence of oxygen, as the air/fuel ratio passes from lean to rich, there is a sharp transition between the levels. This transition will be sensed by a thresholding comparator 32 as stoichiometric.

In the preferred implementation the comparator generates a relatively low signal when the sensor voltage level is above the threshold and a relatively high signal when the sensor voltage is below the threshold. These comparator level changes are then directly input to an integral controller 34 which has a characteristic ramp rate.

When the comparator 32 is at one level, for example high, the integrator 34 will ramp in a direction that will increase the fuel supplied to the engine, and when the comparator 32 is at the other level, for example low, the integrator will switch and will ramp in a direction that will decrease the fuel supplied to the engine. The increase and decrease in the amount of the fuel supplied to the engine is caused by the lengthening or shortening of the pulse width signal of the air/fuel ratio controller 14 in accordance with the integral control voltage.

The integral controller 34 will thus set up a limit cycle oscillation around the stoichiometric value as is characteristic of this type of system. The oscillation frequency is a function of the transport lag of the entire system and is generally $4\tau$. $\tau$ is defined as the time it takes a fuel charge changed by the air/fuel ratio controller to travel to the $O_2$ sensor and its result to be communicated to the electronics.

An integral controller of this type further has an authority limit or an authority which is the peak amplitude that the integrator voltage will reach during the oscillation. Generally, for a set time lag or $\tau$ this is based only upon the integrator gain rate. However, the authority limit will change with a change in $\tau$, as for example as RPM changes since the transport lag is dependent upon speed. Finally, the limit cycle is a function of the maximum voltage range the integrator may swing on either side of the stoichiometric reference point. Thus, the integrator should be kept within its maximum voltage range and should be compensated for speed as will be more fully described. According to the invention, an authority modification circuit 36 is added to the integral controller to provide authority control for a more optimum operation of the closed loop correction of the air/fuel ratio controller 14. The authority modification circuit 36 receives an input via conductor 35 from the integrator 34 which is a conventional integral control voltage developed in response to level changes of the $O_2$ sensor 30.

The authority modification circuit operates to provide a control law to regulate the authority level of the integral control voltage with respect to functional description of the control law and subsequently output a modified control signal to the air/fuel ratio controller 14 to correct the amount of fuel supplied to the engine 10 in concert therewith.

The authority modification circuit 36 in a second implementation receives an input from a transient detector 40 via conductor 41. In this particular embodiment the transient detector receives an input from the MAP sensor 20 and the throttle position sensor 13. The throttle position sensor 13 has an output which is also directed to an idle detector circuit 38 which further becomes an input to the authority modification circuit 36.

Figure 3:
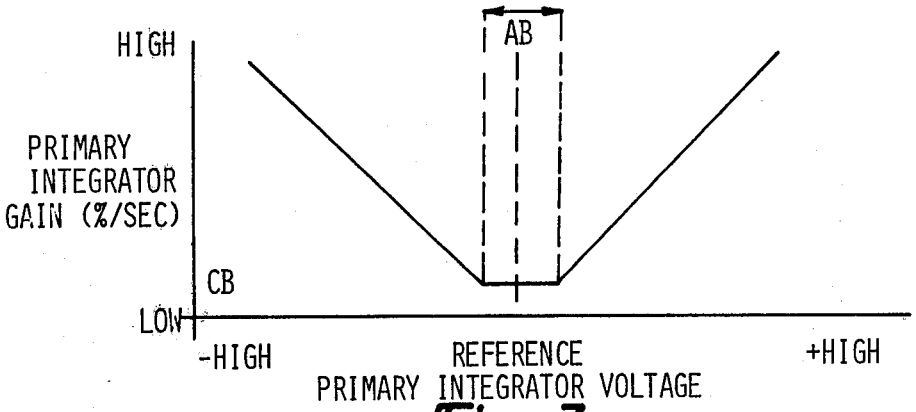
FIGS. 3–5 are representative of graphical relationships of system control laws for the authority modification circut illustrated in FIG. 1.

The control law for the authority modification circuit is illustrated in FIG. 3 where primary integrator gain is graphically illustrated as a function of integrator voltage. It is seen that in proximity to the reference or stoichiometric control there is a band AB wherein the primary integrator gain is the constant and relatively low (value CB). This gain is used for providing a small authority band during steady state conditions such as constant loads and speeds.

For operation outside of a voltage band AB, either plus or minus, the primary integrator gain is a function of the absolute value of the increasing integral control voltage. This produces a system whereby the farther the integrator excursion from the reference or stoichiometric point, the higher the gain becomes until it reaches a maximum or full gain that is provided by the integrator. The system will adaptively change the gain from a minimum to a maximum depending upon the distance away from the reference.

Thus, the system will rapidly correct for transients that are a substantial distance from the reference point but will not cause the system to overshoot and become unstable in the process because as the integrator moves closer and closer to the reference, the gain is reduced until it becomes the relatively low constant gain of the steady state band. Negative excursions are likewise handled in the identical manner according to the mirror image of the representation shown in FIG. 3.

Figure 4:
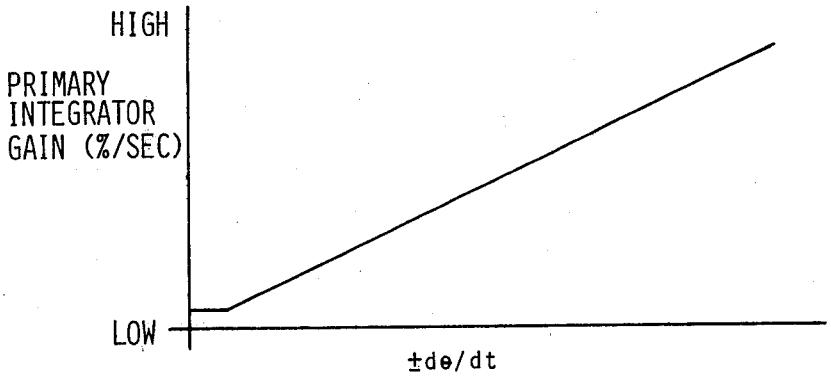
Figure 5:
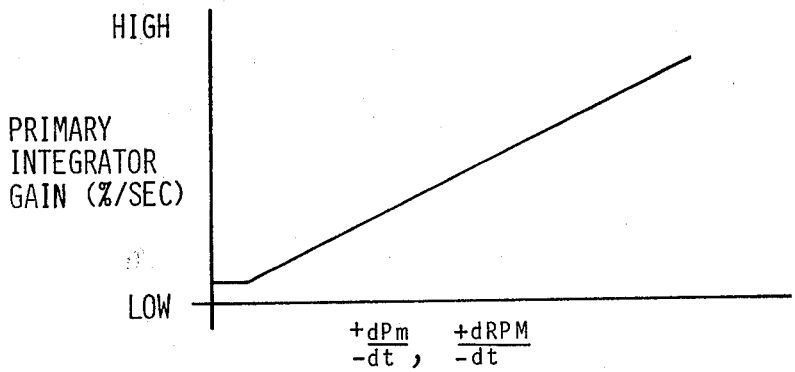

With reference now to FIG. 4 it is shown that a transient caused by an operator induced variable may also be corrected by closed loop control. One of the most common transients, of course, in the operation of an internal combustion engine used in the automotive area is an acceleration or deceleration. It is known that a measure of the transients generally caused by operators can be conventionally recognized by taking the rate of change of the throttle angle with respect to time or, as in FIG. 5, the rate of change of the manifold pressure with respect to time. If a high rate of change of one of these transients is detected, the integrator gain rate should be increased to allow the system to follow the transient quickly but when the transient has been compensated for, for example when the rate of change becomes relatively low, the integrator gain should be decreased back to the steady state control level.

Likewise, with change in intake manifold pressure not only with sensing the desire for an operator induced acceleration or deceleration but a low change could be sensed in this manner where the rate of change of manifold pressure being relatively large will cause a high integrator authority level or gain range and a low rate of change will reduce the integrator gain to a substantially lower level.

Figures 6, 7, 8:
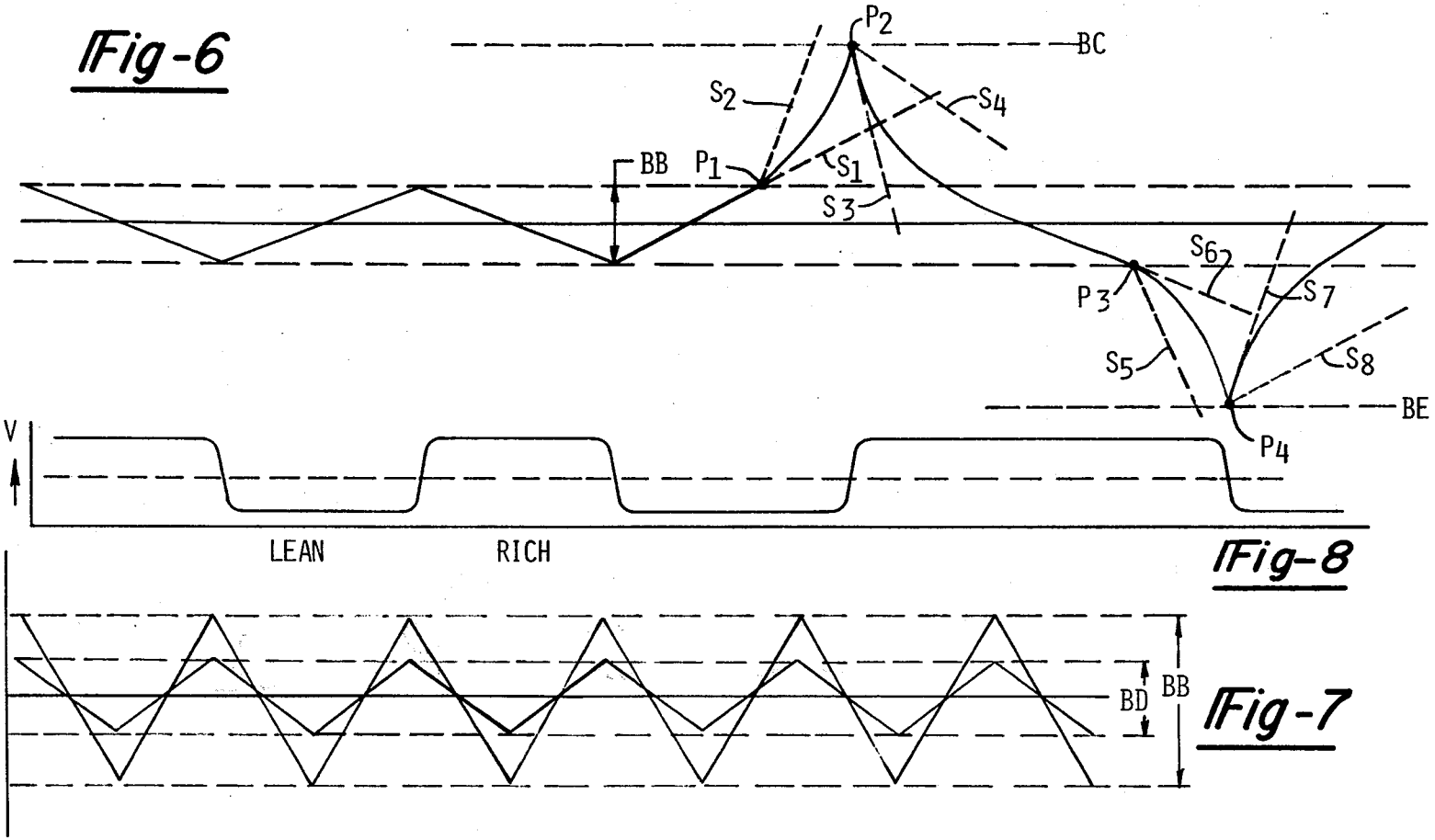
FIG. 6 is a graphical representation of the integral control voltage for correcting the open loop schedule of the air/fuel ratio controller illustrated in FIG. 1.
FIG. 7 is a graphical representation of the integral control voltage for correcting the open loop schedule of the air/fuel ratio controller illustrated in FIG. 1 during idle conditions.
FIG. 8 is a graphical representation of the output voltage of the oxygen sensor illustrated in FIG. 1 on the same time base as that shown in FIG. 6.

These variables integrator voltage and rate of change of manifold pressure RPM or throttle angle can be used in combination or separately to provide the control of the integrator gain as illustrated in FIG. 6.

With reference now to FIG. 6 there is shown a voltage waveform output from the modification circuit that is input to the air/fuel ratio controller to either lengthen or shorten the fuel pulse width and thus change the air/fuel ratio of the engine 10. The first section BB illustrates that a steady state condition exists and the integrator control voltage remains within the steady state threshold limit set and the integrator voltage remains at a small authority level with a relatively low integration rate.

At point $P_1$, however, a transient or some other condition has occurred to move the systems from the reference level and the gain rate will be increased as the curved part of the waveform indicates to where the system once again switches with respect to the $O_2$ sensor at $P_2$ and thereafter the gain rate will fall off as the integrator control voltage approaches the reference once more.

The minimum slope of the integrator is $S_1$ and the maximum is $S_2$. The integrator gain will be modified between these slopes to respond to transients rapidly without overshoot. Levels BC, BE represent the maximum integrator excursions possible and the gain will reach a maximum value $S_2$ before these levels are reached. Point $P_4$ illustrates the integrator approaching the reference from a maximum value $S_7$ and thereafter falling off to the minimum value $S_8$ as the system approaches the threshold limit BB.

It is seen in the next figure, FIG. 7, that steady state conditions or excursions below the threshold level will produce a somewhat stable authority level BB in which the limit cycle oscillation will remain fairly constant. However, for a special type of condition such as an idle condition, the authority level will be reduced to allow the engine to run smoother without torque roll or roughness at low RPM's as illustrated by the smaller authority band BD.

Figure 2:
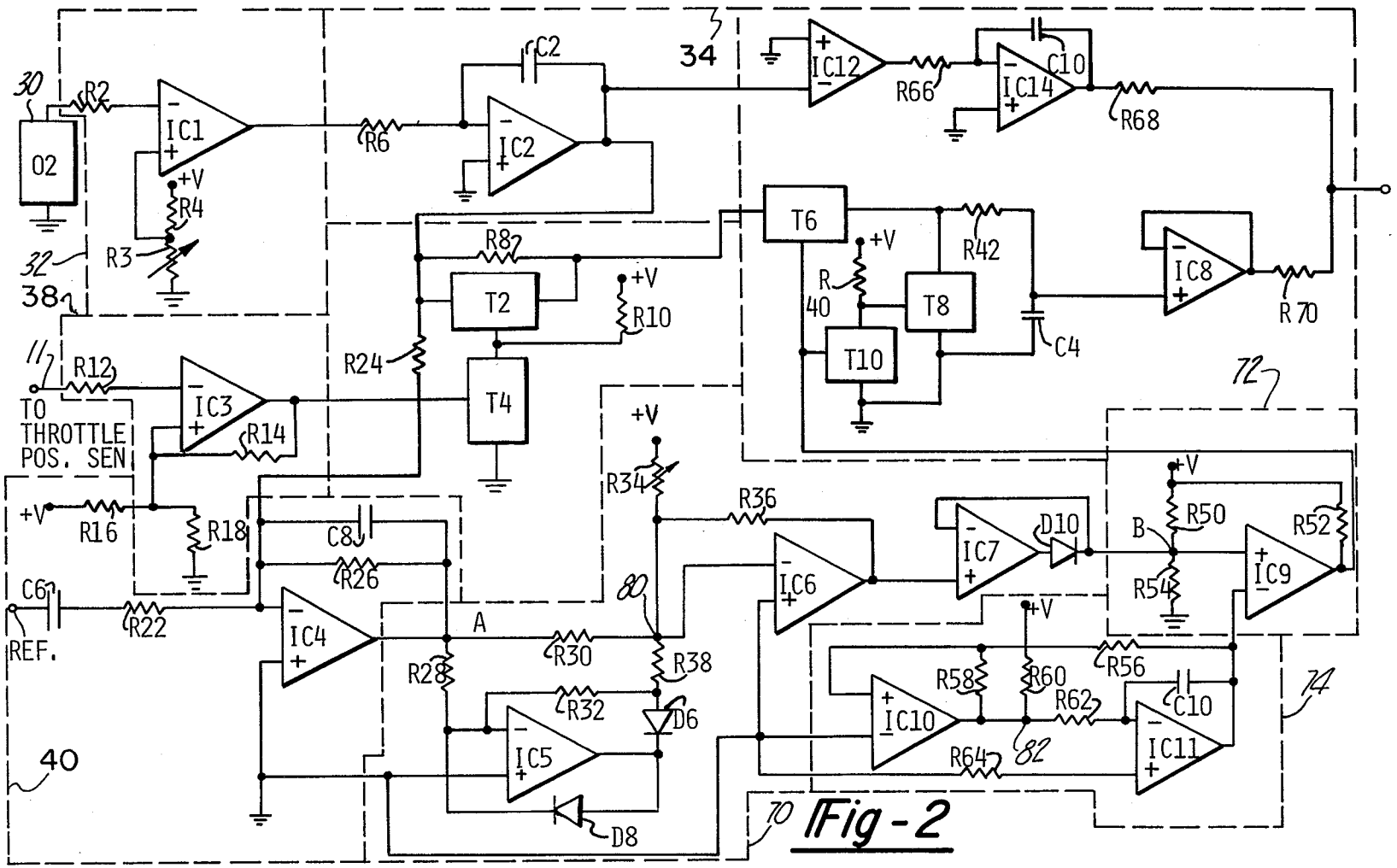
FIG. 2 is a detailed schematic diagram of circuitry implementing the blocks within the dotted area of FIG. 1 and their interrelation.

The idle authority control will now be more fully explained with reference to FIG. 2. Detailed circuitry in FIG. 2 shows an idle detector comprising a differential amplifier IC3 which has a threshold voltage developed at its non-inverting input via the junction of a pair of bias resistors R16 and R18 connected between a source of positive voltage +V and ground. The inverting input of amplifier IC3 is connected via input resistor R12 to the throttle position sensor 29. The amplifier IC3 is also provided with a latching resistor R14 connected between the output and the non-inverting input. The throttle position sensor provides a variable voltage depending upon the position of the throttle having a lower voltage when the throttle is almost closed and higher voltage when the throttle is fully open. At some point the throttle position sensor voltage will drop below the threshold voltage developed at the non-inverting input of the amplifier IC3 and the amplifier will detect a closed throttle which is the indication of an idle condition. At this time, the output of the amplifier IC3 will become relatively high and turn on a conduction device T4 via its control lead.

The operation of the device T4 will turn off a conduction device T2 which is normally on via a bias to its control electrode through a resistor R10 connected to a positive supply of voltage +V. The turning off of the conduction device T2 will add a resistor R8 into the output circuit of the integrating amplifier IC2 and thus reduce the authority level of the integrator depending upon the value of the resistance R8. At voltages of the throttle position sensor above the threshold of the amplifier IC3, the output of the amplifier is low and the conduction device T2 bypasses the resistor R8 and provides no attenuation for the authority level of the output of integral control amplifier IC2.

The detailed circuitry of the authority modification circuit will now be more fully explained if attention is now directed to FIG. 2. Illustrated in that figure is the modification circuitry comprising an absolute value detection circuit 70 with a breakpoint value and a voltage multiplier circuit 72 connected to an oscillator circuit 74.

The absolute value detection circuit 70 receives a control voltage at point A representative of the system error and outputs an authority modification signal to the multiplier at point B which is the absolute value of the control signal minus a breakpoint or threshold value. The authority modification signal then regulates the multiplier to change the authority range of the integrator between a maximum value and a minimum value linearly in response to the modification signal.

To understand the operation, assume the absolute value circuit 70 receives voltages at point A and transmits these via resistor R30 to a node 80. Voltage A is also transmitted to node 80 via an inverting amplifier IC5 and resistor R38. Amplifier IC5 has an input resistor R28 connected to its inverting input. A gain resistor R32 is also connected at the inverting input of amplifier IC5 and to the anode of the diode D6 which is connected at its cathode to the output of the amplifier. Further, a feedback diode D8 is connected at the output of amplifier IC5 at its anode and is connected at its cathode to the inverting input.

Resistors R28, R30 and R32 are identically sized and resistor R38 is one-half the value of the three identically sized resistors. This provides the amplifier IC5 with a forward voltage gain of −1 and will for positive inputs provide a voltage −2A at the node 80 through diode D6 and the resistor R38. Since there is already a voltage +A at node 80, the resultant voltage for a positive input at point A is the difference between the two or −A. For negative inputs, −A is received via resistor R30 to node 80 and the inverting amplifier IC5 blocks diode D6 from supplying further voltage to the node. Also, diode D8 will conduct and through negative feedback to the inverting input and reduce the voltage gain of the amplifier zero. Therefore, positive or negative voltages will be converted to an absolute value.

A threshold or breakpoint value is provided to the node 80 via a variable resistor R34 connected at one terminal to the node and connected at the other to a positive source voltage +V. Since the value of the threshold or breakpoint is positive and the voltage at node 80 for all values of A is negative, the same breakpoint is given to both sides of the control law.

The voltage at node 80 is thereafter input to an inverting input of an amplifier IC6 which has its output connected via resistor R36 to node 80. Amplifier IC6 is an inverting amplifier and may have a gain dependent upon the ratios of the resistances R30 and R36, but preferably has a gain of −1. Since the input to the node 80 is −A for positive and negative values of voltage at point A, the output of the voltage amplifier IC6 is +A and in proportion to the voltage seen at point A.

This absolute value of the control voltage is fed into the non-inverting input of a current amplifier IC7 which acts as a voltage follower. The output terminal of the amplifier IC7 is connected via diode D10 to the node labeled B. Further, the amplifier has a feedback conductor connected between the cathode of diode D10 and the inverting input. Thus, the amplifier IC7 will attempt to supply current via resistor R54 to ground to balance the inverting and non-inverting inputs and bring the value of the voltage at point B into equivalence with the output of the amplifier IC6.

The voltage at point B is fed into the non-inverting input of the amplifier IC9 which it receives from its inverting input the output of the oscillator 74. The oscillator 74 provides a triangular-shaped osccillation which has a center or reference voltage imposed thereon. The oscillator acts as an astable multivibrator by a feedback resistor R56 connected between the output of an amplifier IC11 and the non-inverting input of an amplifier IC10. The output of the amplifier IC10 is connected to the inverting input of the amplifier IC11 via a resistor R62. Additionally connected at the inverting input of amplifier IC11 is a timing capacitor C10 whose other terminal is connected to the output of the amplifier. A feedback resistor R58 is connected to the output of amplifier IC10 and thereafter connected to the non-inverting input. The oscillation is set up by causing the amplifier IC11 to integrate in the negative direction via the bias resistor R60 connected to a source of positive voltage +V and connected to the inverting input. The voltage will continue to decrease from amplifier IC11 until it is fed back via the amplifier IC10 to overcome the initial voltage at node 82 according to the time constant of the capacitor C10 and the resistance of the circuit. At that time, the amplifier IC11 will switch and ramp in the positive direction causing node 82 to become more positive once more and switch after the time constant of the circuit has been elapsed.

The oscillation applied to amplifier IC9 will cause the amplifier to saturate at any points in which the triangular wave is greater than the variable modification signal at point B. This will cause a square wave output from the amplifier IC9 which has a variable on/off duty cycle as the ratio which is dependent upon the voltage at the point B. The higher the voltage at point B, the more on time the amplifier IC9 will provide and conversely lower the voltage at point B, the more off time the amplifier IC9 will deliver.

The output of the amplifier IC9 is connected to the control electodes of devices T6 and T10 respectively. The power terminals of the device T6 are connected at one terminal to the output of the integrator via device T2 and at the other terminal connected to a capacitor C4 via a resistor R42. The power terminals of device T10 are connected between a positive supply of voltage +V via resistor R40 and ground conduction device T8 is connected to the junction of the power terminal of the conduction device T10 and the resistor R40 and is connected at its power terminals to the output power terminal of the conduction device T6 and ground via resistor R43.

During on times of the amplifier IC9, the conduction device T6 is in on state charging capacitor C4 via resistor R42. On times of amplifier IC9 also cause conduction device T10 to operate grounding the control terminal of device T8 and thereby disabling it. During the off times of the amplifier IC9 the conduction device T8 is operational via the resistor R40 connected to the positive source of voltage +V and will discharge the resistor 42, capacitor C4 via the conduction path R42, conduction device T8, and resistor R44 and ground. Thus, the voltage on capacitor C4 is directly dependent upon the proportionality of the or ratio of the on and off times of the amplifier IC9 and consequently the voltage at point B.

Amplifier IC8, which is connected to the capacitor C4 at node C via its non-inverting input and has a feedback conductor from its output to its inverting input, is a voltage follower which when connected to an air/fuel ratio controller 14 through resistor R70 will produce a voltage that will be of equivalent value to that of the capacitor C4.

A secondary integrator comprising operational amplifier IC14 with a much slower ramp rate and high authority level can be used. The output of the amplifier IC14, which has an integrating capacitor C10 connected between its output and inverting inputs and its non-inverting input connected to ground, is scaled by resistor R68 to be combined with the signal of resistor R70. Input to the secondary integrator is from the output of amplifier IC2 via an inverting comparator IC12. When the integrator 34 is increasing in a positive direction IC14 will be increasing or integrating in a positive direction and vice versa. If integrator 34 reaches the maximum excursion level without switching, the integrator IC14 will help recenter the system as is known.

While preferred embodiments of the invention have been described, it will be obvious to those skilled in the art that various modifications and changes may be made therein without departing from the spirit and scope of the invention as defined in the following appended claims.

What is claimed is:

1. A closed loop system for the control of the air/fuel ratio of an internal combustion engine comprising:

an air/fuel ratio controller for regulating the air/fuel ratio of the internal combustion engine according to a calculation based upon a predetermined fuel schedule and the sensing of at least one operating parameter of the engine;

integral controller means for modifying said regulation of said air/fuel ratio controller with a closed loop correction signal wherein said controller means is responsive to the bi-level output of an exhaust gas sensor, said integral controller means incrementally increasing the air/fuel ratio of the engine when the sensor detects a rich condition and outputs a first level, said integral controller means incrementally decreasing the air/fuel ratio of the engine when the sensor detects a lean condition and outputs a second level; and authority modification means for regulating the authority of said integral controller means between a maximum value and a minimum value dependently upon the absolute value of the magnitude of the system error.

2. A closed loop system as defined in claim 1 which further includes:

idle control means for regulating the authority level of said integral control means in response to the detection of an idle condition.

3. A closed loop system as defined in claim 2 wherein said idle control means comprises:

an idle detector connected to the output of a throttle position sensor, said idle detector generating an idle signal upon detecting a closed throttle condition from said position sensor; and attenuation means connected to said idle detector and responsive to said idle signal for reducing said authority level to less than said minimum level when said idle signal is present.

4. A closed loop system as defined in claim 1 wherein:

said authority modification means further includes transient detector means for detecting the absolute value of the rate of change of an engine operating parameter related to air/fuel ratio and utilizing said rate of change signal as the error signal.

5. A closed loop system as defined in claim 4 wherein said authority modification means includes:

absolute value detection means for detecting positive or negative changes in the system error and converting said changes into absolute values;

multiplier circuit means for receiving the absolute value of the system error signal and for receiving an alternating frequency signal from an oscillator said multiplier circuit combining said error signal and said frequency signal to generate a variable duty cycle wave having said duty cycle dependent upon a function of the error signal.

6. A closed loop system as defined in claim 5 wherein said multiplier circuit means further includes:

regulation circuit means, receiving said variable duty cycle wave and receiving said closed loop correction signal, for attenuating said correction signal dependently upon said duty cycle of the variable wave.

7. A closed loop system as defined in claim 6 wherein said regulation circuit means comprises:

a series cnduction device connected between the input of said closed loop correction signal and a capacitor means for charging said capacitor means;

a shunt conduction device connected between said capacitor means and ground for discharging said capacitor means; and said series conduction device and shunt conduction device being alternately energized by said variable duty cycle wave such that the on time and off time of the devices varies with said duty cycle.

8. A closed loop system as defined in claim 7 wherein said multiplier circuit further includes:

said oscillator generating the alternating frequency as a triangular waveshape;

comparison means for comparing the magnitude of said system error signal to said alternating frequency; said comparison means generating one level if the error is greater than the waveshape and generating a second level if the waveshape is greater than the error signal.

9. A closed loop system as defined in claim 8 wherein said absolute value detection means includes means for providing a breakpoint value wherein said error signal must exceed the breakpoint value before the absolute value of the signal is generated.

10. A closed loop system as defined in claim 4 wherein:

said transient detector means includes a differentiator receiving a voltage representative of the operating parameter and changing therewith.

11. A closed loop system as defined in claim 10 wherein said parameter is throttle position.

12. A closed loop system as defined in claim 11 wherein said parameter is manifold absolute pressure.

13. A closed loop system as defined in claim 12 wherein said parameter is the operational velocity of the engine.

14. A closed loop system as defined in claim 1 wherein:

the magnitude of the error signal is measured as the absolute value of the amount the closed loop correction signal is away from a reference value.

15. A closed loop system as defined in claim 3 wherein said idle detector includes:

a comparator having an input from the throttle position sensor including a position signal which is a variable voltage having a minimum amplitude at closed throttle and a maximum amplitude at open throttle; said comparator receiving as a second input a threshold voltage and generating said idle signal when the position signal is less than the threshold.

16. A closed loop system as defined in claim 15 wherein said attenuation means includes:

a series impedance connected between the closed loop correction signal and the air/fuel ratio controller; and a conduction device connected in parallel with said series impedance, said conduction device controlled by said idle signal such that the device is on and shunts said series impedance when the idle signal is absent and the device is off and causes impedance to attenuate the correction signal when the idle signal is present.

* * * * *